US006470878B1

(12) United States Patent
Brown et al.

(10) Patent No.: US 6,470,878 B1
(45) Date of Patent: Oct. 29, 2002

(54) FURNACE HEAT EXCHANGER

(75) Inventors: Michael Lee Brown, Greenwood, IN (US); Shailesh Sharad Manohar, Manlius, NY (US); Ninev Karl Zia, Indianapolis, IN (US); Scott Andrew Beck, Indianapolis, IN (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/692,983

(22) Filed: Oct. 23, 2000

(51) Int. Cl.[7] ..... F24H 3/02

(52) U.S. Cl. ..... 126/110 R; 126/99 R; 165/170; 165/147

(58) Field of Search ..... 126/110 R, 99 R, 126/116 R, 99 C; 165/170, 147, 174

(56) References Cited

U.S. PATENT DOCUMENTS

| | | | | | |
|---|---|---|---|---|---|
| 2,169,054 | A | * | 9/1939 | Mojonnier | 257/187 |
| 3,294,082 | A | * | 12/1966 | Norris | 126/116 |
| 3,554,273 | A | | 1/1971 | Kritzler | 165/10 |
| 3,661,203 | A | | 5/1972 | Mesher | 165/167 |
| 3,807,382 | A | * | 4/1974 | Kennedy | 126/116 R |
| 3,983,935 | A | * | 10/1976 | Henrion | 165/166 |
| 4,019,572 | A | | 4/1977 | Harlan et al. | 165/106 |
| 4,335,782 | A | | 6/1982 | Parker | 165/1 |
| 4,467,780 | A | * | 8/1984 | Ripka | 126/110 R |
| 4,951,651 | A | | 8/1990 | Shellenberger | 126/116 |
| 5,178,124 | A | | 1/1993 | Lu et al. | 126/110 |
| 5,301,654 | A | | 4/1994 | Weber, III et al. | 126/110 |
| 5,346,001 | A | * | 9/1994 | Rieke et al. | 165/170 |
| 5,359,989 | A | * | 11/1994 | Chase et al. | 126/110 R |
| 5,417,199 | A | * | 5/1995 | Jamieson | 126/110 AA |
| 5,437,263 | A | * | 8/1995 | Ellingham et al. | 126/110 R |
| 5,448,986 | A | | 9/1995 | Christopher et al. | 126/110 |
| 5,636,527 | A | * | 6/1997 | Christensen et al. | 62/476 |
| 6,109,254 | A | * | 9/2000 | Reinke et al. | 126/110 R |

* cited by examiner

*Primary Examiner*—Ira S. Lazarus
*Assistant Examiner*—K. B. Rinehart

(57) ABSTRACT

A furnace heat exchanger with multiple parallel flow passages with at least two of the passages being partially formed of a pair of opposed sidewalls having wavy cross-sectional shapes wherein the downstream passage has at least as many and preferably more waves than the upstream pass. The wavy shapes are preferably generally sinusoidal in form with the waves of the two sides being substantially in phase.

19 Claims, 14 Drawing Sheets

FURNACE HEAT EXCHANGER

BACKGROUND OF THE INVENTION

This invention relates generally to furnaces and, more particularly, to multipass heat exchangers therefor.

A typical residential furnace has a bank of heat exchange panels arranged in parallel relationship such that the circulating blower air passes between the panels to be heated before it passes to the distribution duct. Each of the panels is typically formed of a clamshell structure which has an inlet end into which the flame of a burner extends to heat the flue gas, an outlet end which is fluidly connected to an inducer for drawing the heated flue gas therethrough, and a plurality of legs or passes through which the heated flue gas passes. In order to obtain the desired high efficiencies of operation, it is necessary to maximize the heat transfer that occurs between the heated flue gas within the heat exchanger passes and the circulating air passing over the outer sides of the heat exchanger panels. Further, there are required performance and durability requirements for the heat exchanger panels themselves.

One requirement is that the internal pressure drop within the heat exchanger panels is maintained at an acceptable level. That is, in order to minimize the inducer motor electrical consumption costs, it is necessary that the pressure drop be maintained at suitable levels.

Durability of the heat exchanger panels is also an important requirement. In order to obtain long life, the heat exchanger panels must be free of excessive surface temperatures, or hotspots, and the thermal stresses must be minimized. Further, the need for expensive high temperature materials is preferably avoided.

A more recent requirement is that of reducing the height of the heat exchanger panels. This is important for a number of reasons. First, it allows the overall height of the furnace to be reduced such that it can be placed in smaller spaces, such as in attics, crawl spaces, closets and the like. Secondly, it allows for a reduction in costs, both in the costs of the heat exchanger panels themselves and in the cost of the furnace cabinet. But this reduction in height must be done without sacrificing performance. That is, a simple reduction in height, with a proportionate reduction in performance, would not be acceptable. It is therefore necessary to obtain increased performance for a given length or height of the heat exchanger panels.

It is therefore an object of the present invention to obtain an improved heat exchanger for a furnace.

Another object of the present invention is to reduce the overall height of the heat exchanger in a furnace.

Yet another object of the present invention is the provision in the furnace for reducing the size of the heat exchanger while maintaining performance levels.

Another object of the present invention is the provision for a durable heat exchanger with controlled surface temperatures, reduced hotspots and minimal thermal stresses.

Still another object of the present invention is the provision for a heat exchanger with minimal internal pressure drop.

A further object of the present invention is the provision for a heat exchanger which is economical to manufacture and effective and efficient in use.

These objects and other features and advantages become readily apparent upon reference to the following descriptions when taken in conjunction with the appended drawings.

SUMMARY OF THE INVENTION

Briefly, in accordance with one aspect of the invention, the heat exchanger surface area, per unit height of a multipass heat exchanger, is increased by providing wavy cross-sectional shapes in the sides of at least two of the passes. Optimal efficiency is obtained while maintaining the pressure drop within the panels at an acceptable level by having the number of waves in the downstream pass being equal to or greater than those in the upstream pass. In this way, high-efficiency heat transfer performance is obtained, while minimizing the flueside pressure drop and the operating costs of the inducer.

In accordance with another aspect of the invention, the wavy shapes are generally sinusoidal in shape, and each side may extend inwardly to or beyond a common central plane.

By another aspect of the invention, there is a single pass in which the cross-sectional shape transitions from a non-wavy shape to a wavy shape. This transition section is of a substantial length, such that the transition from one shape to the other is gradual, thereby providing for reduced temperatures and stresses in that section.

In accordance with another aspect of the invention, a gooseneck shape is provided in the last passage, such that, as the passage approaches the outlet, it curves downwardly toward the second to last passage so as to result in a lower overall height of the heat exchanger while minimizing the reduction of the cross-sectional area of the flow passage.

By yet another aspect of the invention, the first return bend of the heat exchanger varies in cross sectional area in the direction of gas flow, first increasing and then decreasing, so as to reduce the occurrence of hot spots while avoiding an increase in overall height of the heat exchanger.

In the drawings as hereinafter described, preferred embodiments are depicted; however, various other modifications and alternate constructions can be made thereto without departing from the true spirit and scope of the invention

DESCRIPTION OF A PREFERRED EMBODIMENT

Figure 1:
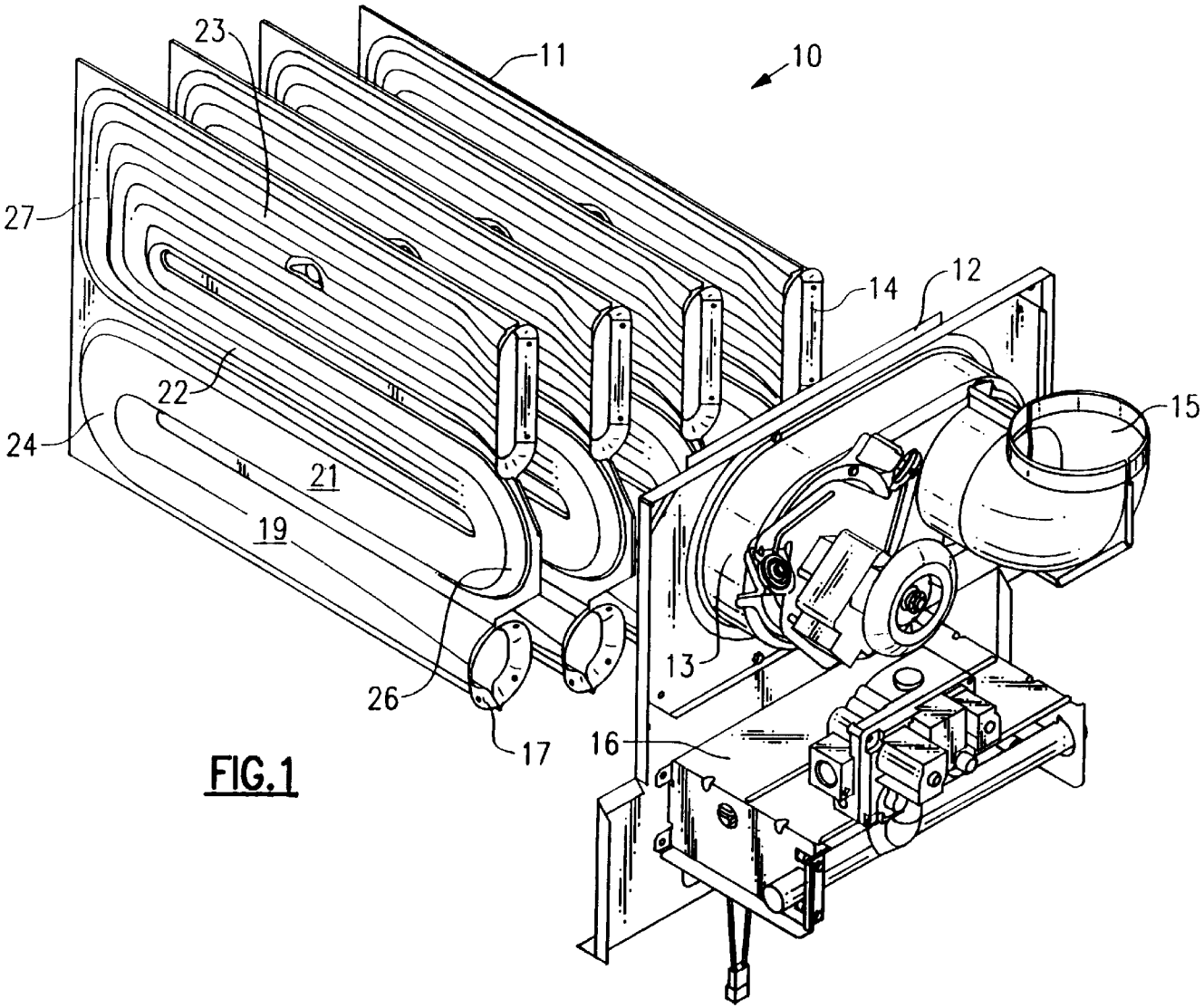
FIG. 1 is an exploded perspective view of an operating portion of a furnace in accordance with the present invention.

Referring now to FIG. 1, the invention is generally shown as part of a furnace system including a bank 10 of heat exchanger panels 11. A collector box 12 is connected to an inducer 13 in such a way as to permit the drawing of heated flue gases through the heat exchanger panels 11. That is, the outlets 14 of the heat exchanger panels 11 are connected directly to the collector box 12, where a vacuum is drawn by the inducer 13, with the flue gases being exhausted out a vent by way of the elbow 15.

At the other end of the heat exchanger panels 11, a burner assembly 16 is provided for purposes of combusting the fuel and air mixture, with the flame extending into the heat exchanger panels 11. For that purpose, individual burners in the burner assembly 16 are aligned with the inlet ends 17 of the heat exchanger panels.

Figure 2:
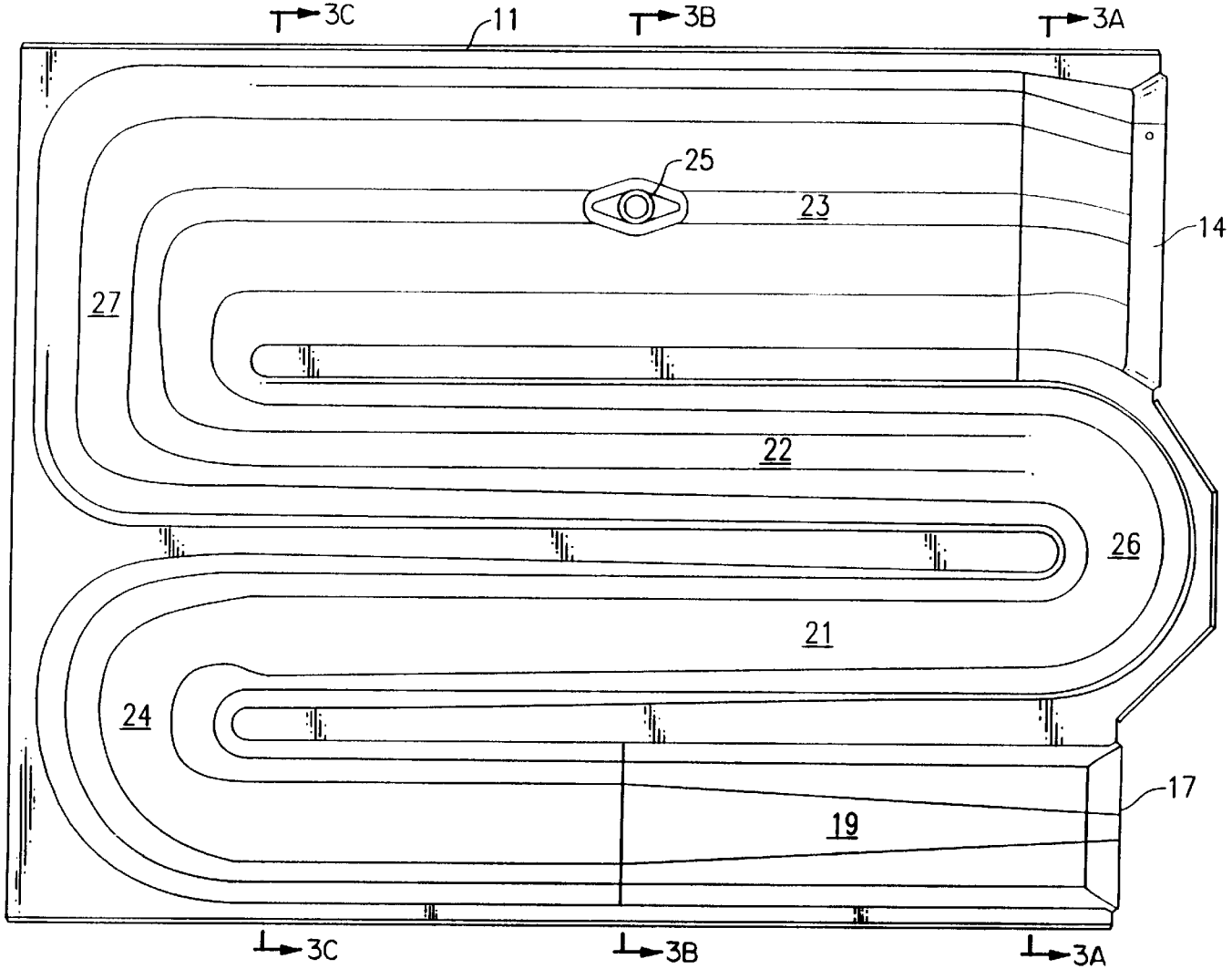
FIG. 2 is a side elevational view of a heat exchanger panel thereof.

Referring now to FIGS. 1–3, a heat exchanger panel 11 is shown to include a first pass 19, a second pass 21, a third pass 22, and a fourth pass 23, all interconnected by way of return bends to provide a continuous flow-through passageway from the inlet end 17 to the outlet end 14. A first return bend 24 interconnects the first pass 19 to the second pass 21, a second return bend 26 interconnects the second pass 21 to the third pass 22, and a third return bend 27 interconnects the third pass 22 to the fourth pass 23. As will be seen, the first and second passes 19 and 21 are generally oval in shape throughout their lengths, whereas the third pass 22 starts out as an oval form and then transitions to a wavy form. This feature will be more fully described hereinbelow. The fourth pass 23 is wavy along its entire length and has near its center an abutting portion 25 to resist any collapsing tendencies.

A partial sectional/perspective view of the fourth pass is shown in FIG. 4 to include the two wavy sides 28 and 29 interconnected at their lower ends by a bonded section 31. This attachment is preferably by way of a TOX™ process, a commercially available process which provides a small tooling footprint between passes. The two sides 28 and 29 are attached at their upper ends by way of a crimping process as shown at 32. As will be seen, the side 28 is formed of three interconnected waves 33, 34 and 36 to form a continuous repetitive pattern. The other side 29 is substantially identical and, as will be seen, the waves are in phase with the waves of side 28. This is the preferred structure in order to provide for simplicity of tooling and an increased surface area in the heat exchanger panel, while at the same time minimizing the pressure drop in the flow gases within the panel. If desired, this in-phase relationship can be varied slightly (such as by placing the two waves out of phase by as much as five degrees, for example) without substantially affecting the pressure drop relationship.

Figure 4A:
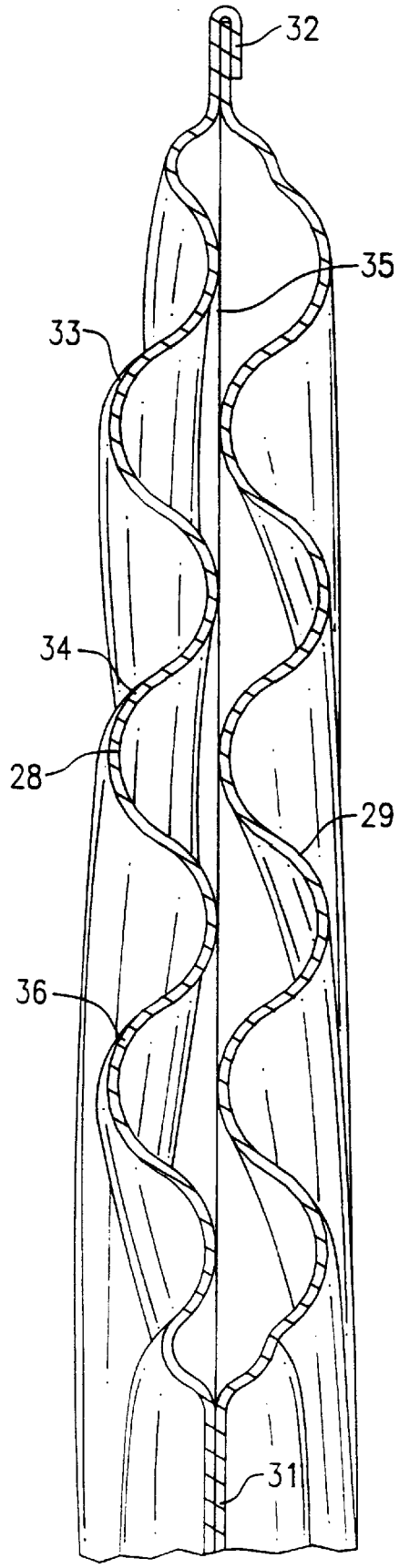
FIG. 4A is a partial perspective view of a single pass of a heat exchanger panel in accordance with the present invention.
Figure 4B:
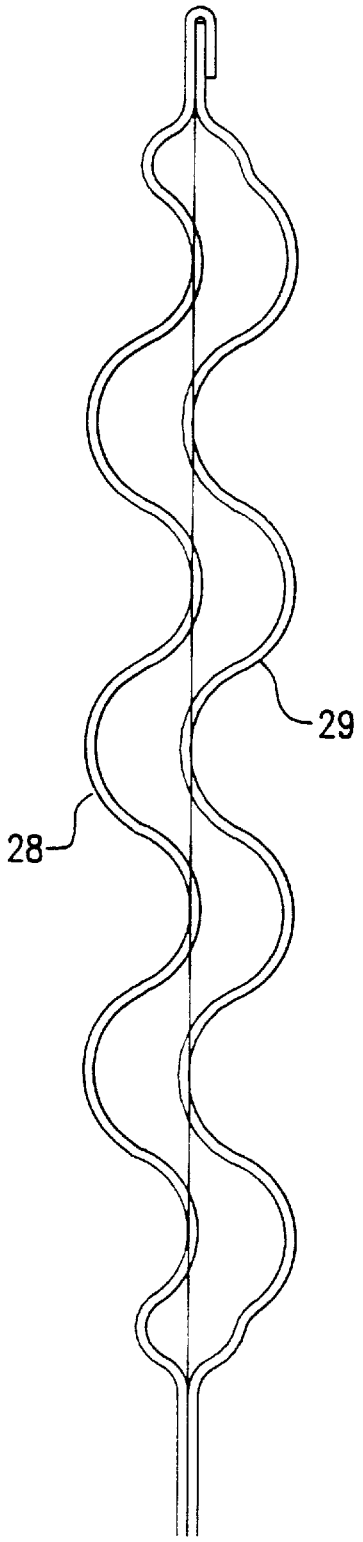
FIGS. 4B through 4F are cross-sectional views of alternative embodiments thereof.
Figure 4C:
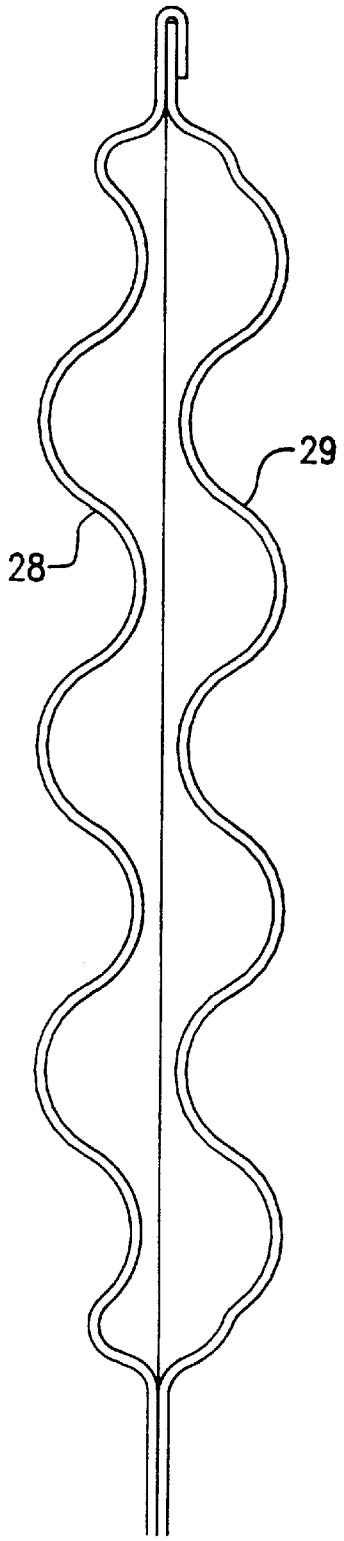

While the two sides 28 and 29 are shown to have their innermost wave portions extend to a common plane 35 located centrally between them, it should be understood that they may also be so formed such that their innermost wave portions extend beyond the common plane 35 as shown in FIG. 4B, or such that their innermost wave portions do not extend to the common plane 35 as shown in FIG. 4C.

It will also be seen in FIGS. 4A–4C that the waveshapes are substantially sinusoidal in form. Although this is the preferred form, other forms of waves may be used, keeping in mind both the ease of manufacturing requirements and the durability requirements, as well as the requirement for maintaining an acceptable pressure drop.

Figure 4D:
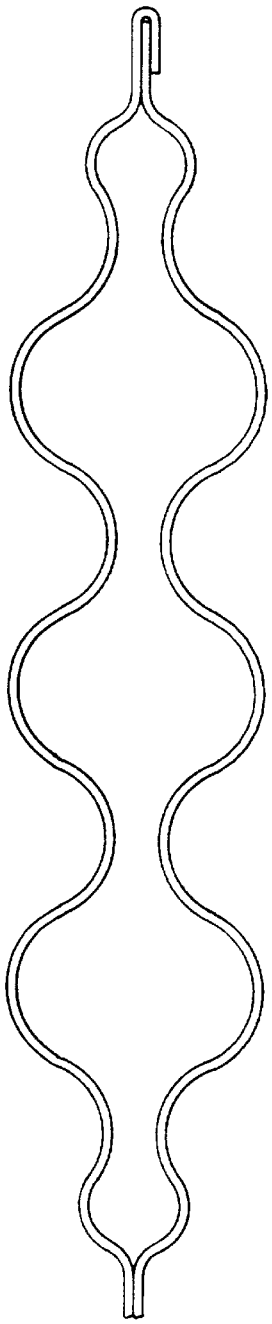
Figure 4E:
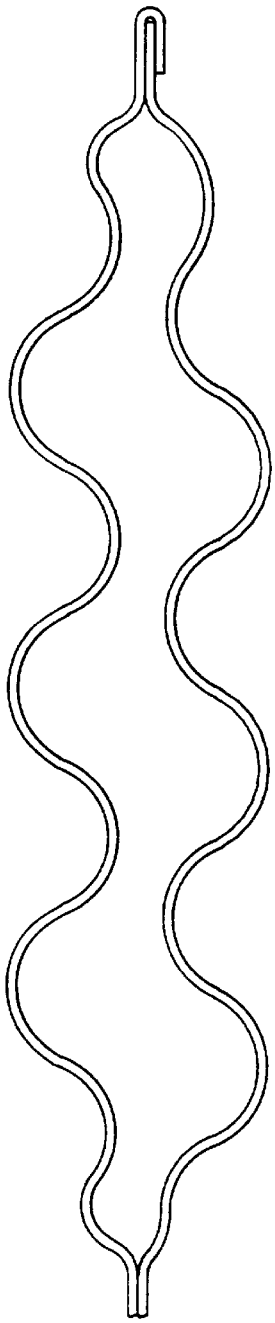
Figure 4F:
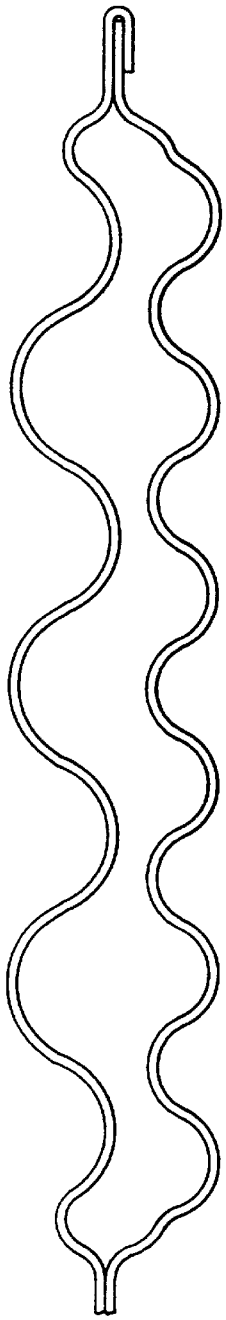

As an alternative one of the sides may be formed in a wave that is out of phase as shown in FIGS. 4D and 4E. Or one side may have a wave that is of a different amplitude and frequency as shown in FIG. 4F.

Figure 3A:
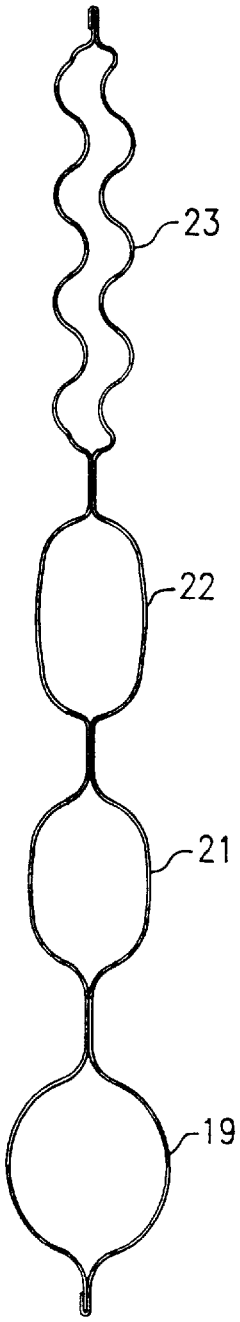
FIGS. 3A–3C are cross-sectional views thereof as seen along lines A—A, B—B and C—C of FIG. 2.
Figure 3B:
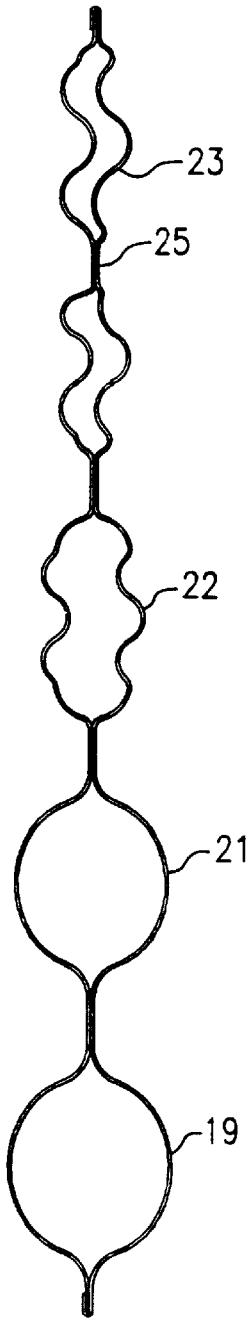
Figure 3C:
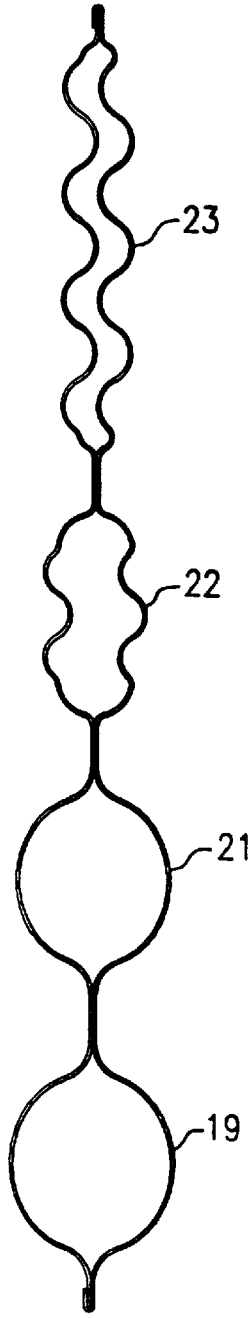

Referring now back to FIGS. 3A–C it will be seen that the third pass 22 is of a lesser height and greater width than the fourth pass 23. Accordingly, the relationship between the two sides is substantially different in the third pass 22. However, like the fourth pass 23, the wavy portion may be substantially sinusoidal in form with the waves of the two sides being substantially in phase, as shown.

It is also significant to note that the number of waves in the fourth pass is equal to or greater than that in the third pass, the reason being that performance is optimized. That is, whereas it is desirable to introduce the wavy shape so as to provide a greater surface area and therefore enhanced heat transfer characteristics, these waves increase the pressure drop within the heat exchanger. It is therefore desirable to provide the waves in the third pass but not so many as would cause an undesirable pressure drop. In the fourth pass, however, the flow gases are cooler and more dense. It is therefore possible to provide the same number and preferable to provide a greater number of waves in the fourth pass than in the third pass so as to achieve the improved performance without an excessive pressure drop.

The height of the fourth pass is preferably greater than that of the third pass. However, with sufficient enhancements, it may be possible to have the height of the fourth pass be equal to or less than that of the third pass.

Figure 5:
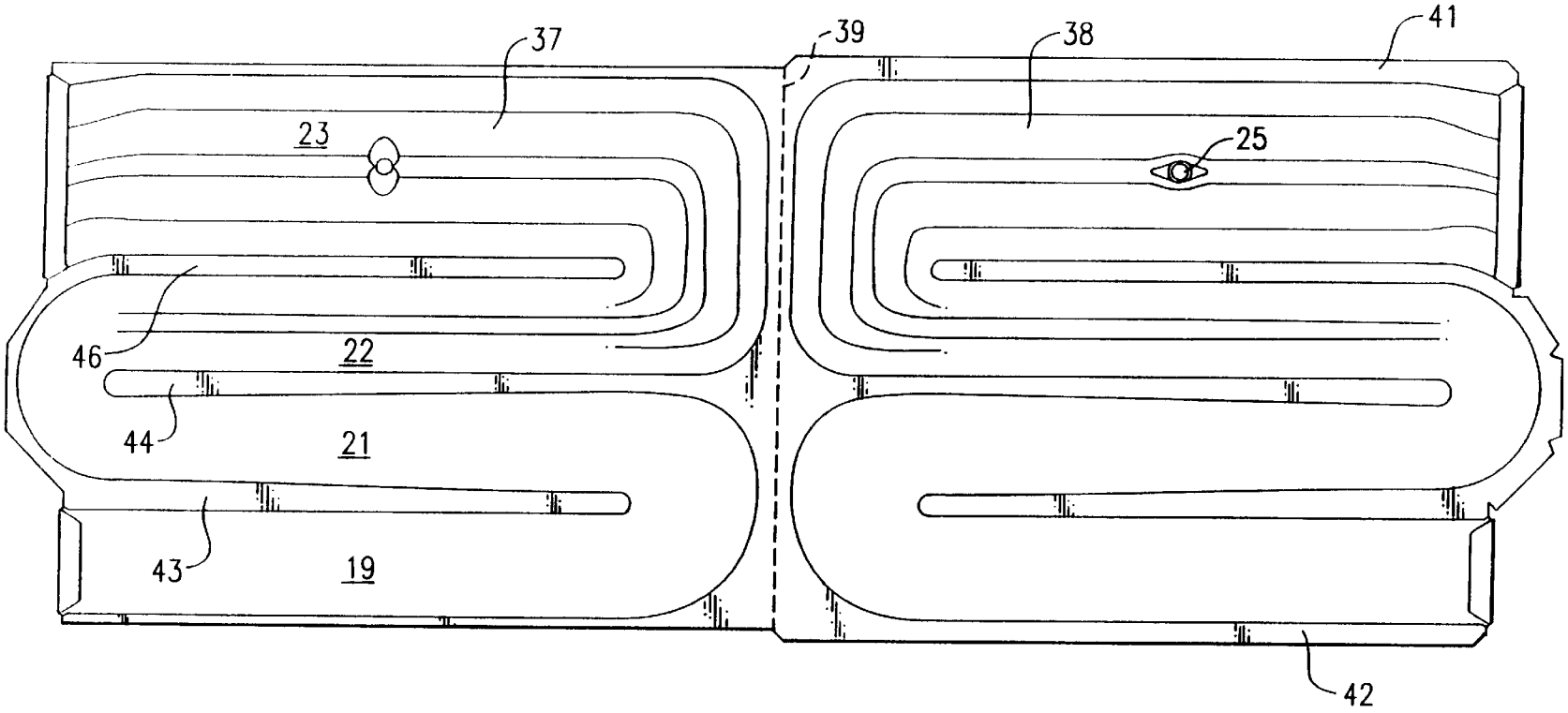
FIG. 5 is a clamshell stamping of a heat exchanger panel in accordance with the present invention.

Referring now to FIG. 5, a single sheet metal stamping is shown as it would appear prior to being formed into the clamshell shape. It is formed in two sides, 37 and 38, with a fold line 39 therebetween. A top edge tab 41 and a bottom edge tab 42 are provided on side 38 for purposes of clamping the two sides together after they are folded at the fold line 39. The clamping together is preferably done by way of the crimping process as discussed above.

Between the respective passes are the lands 43,44 and 46 of side 37. Similar lands are provided on side 38. After the two sides have been folded together, it is necessary to secure portions of the corresponding lands of the two sides 37 and 38 in order to minimize the leakage between passes. This interconnection is preferably done by way of the TOX process.

Figure 6:
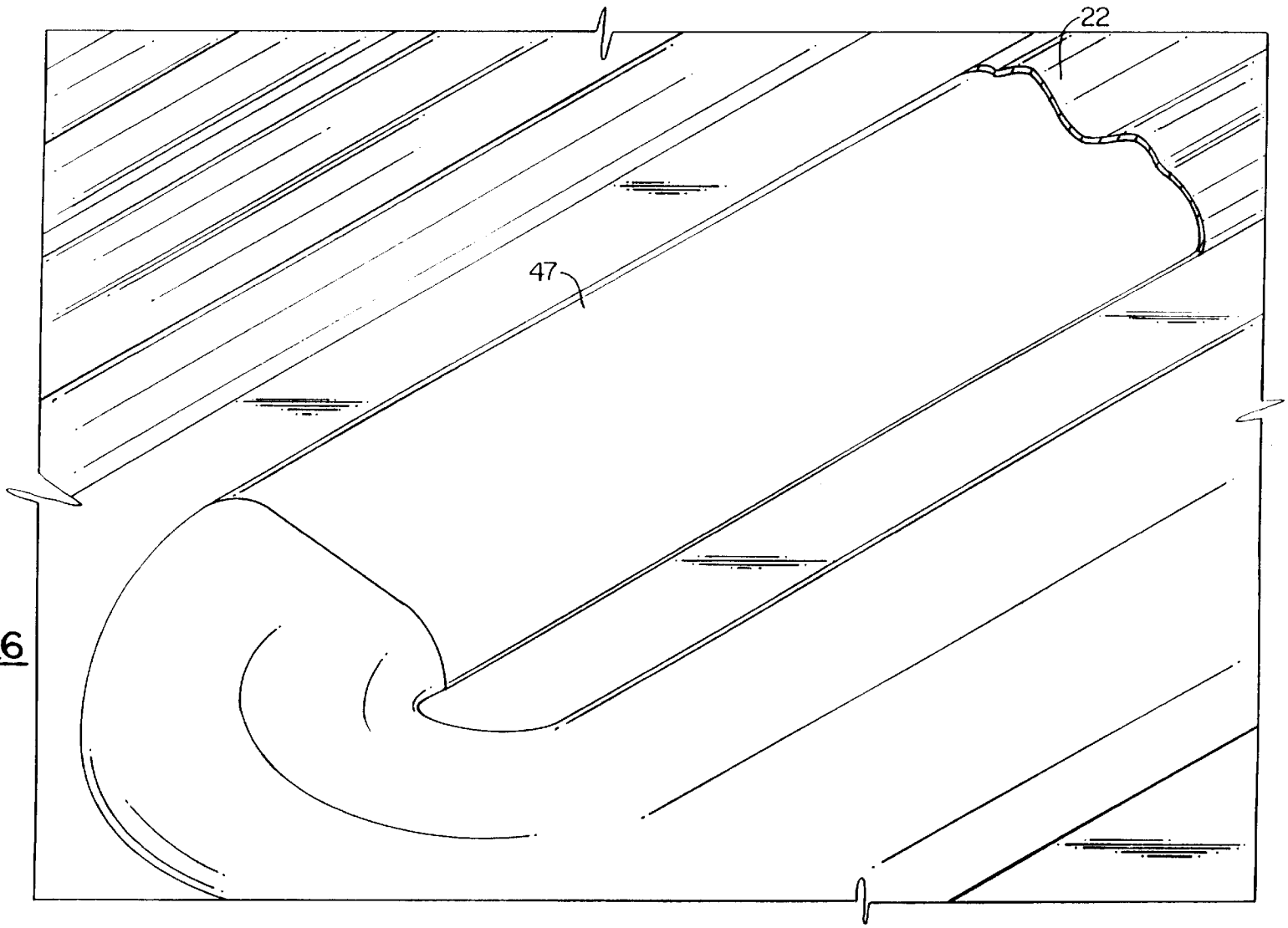
FIG. 6 is a perspective view of a transition portion within a pass of a heat exchanger panel in accordance with the present invention.
Figure 7A:
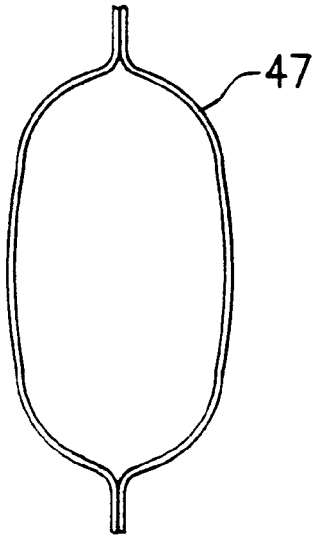
FIGS. 7A–7D are sectional views of the transition portion of FIG. 6 in accordance with the present invention.
Figure 7B:
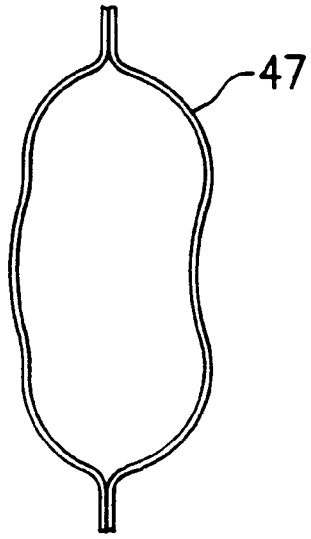
Figure 7C:
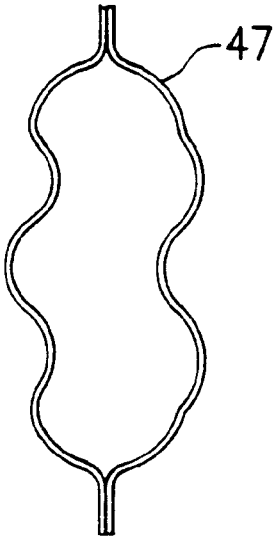
Figure 7D:
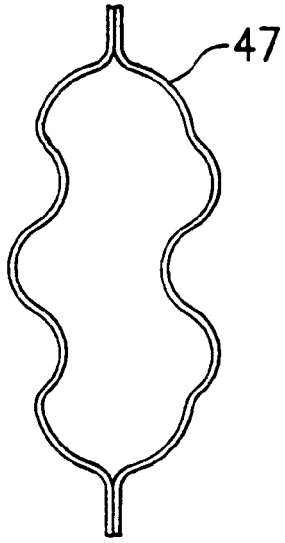

Referring now to FIG. 6, there is shown that portion 47 of the third pass 22 in which the cross-sectional shape of the heat exchanger transitions from a non-enhanced, generally elliptical form as shown at FIG. 7A to an enhanced wavy form as shown at FIG. 7D. The length of this transitional portion is purposely extended so as to reduce the heat exchanger surface hotspots that would otherwise occur if a more abrupt transition were made. Here, the nominal length of the transition portion 47 is six inches, with the cross-sectional shape at its one end being shown at FIG. 7A, that at the two inch point being shown at FIG. 7B, that at the four inch point being shown at FIG. 7C., and that at the other end being shown at FIG. 7D. With such a gradual transition, the temperatures that occur in the walls of the heat exchanger are maintained at a level that will bring about acceptable durability and life performance of the heat exchanger.

The length of the transition portion 47 may, of course, be varied in order to facilitate the requirements of acceptable manufacturing processes, while, at the same time, meeting the performance and durability requirements of the heat exchanger. In this regard, reference is made to FIG. 8 wherein a graphic illustration is shown of the relationship between the length of the transition portion and the maximum temperatures that occur along its length. Actually, in order to make it more meaningful, rather than plotting it as a function of the specific length of the heat exchanger, the normalized parameter that has been chosen to represent the performance data generated by a computer modeling analysis, is the ratio L/Dha, wherein L represents the length of the transition portion, and Dha represents the average hydraulic diameter of the heat exchanger along the length of the transition portion 47.

The hydraulic diameter, Dh, is an "equivalent" diameter defined for flow passages that are non-circular in shape. It is calculated according to the following formula:

$$Dh=4A/P$$

where

A is the cross-sectional area of the flow passage

P is the "wetted" perimeter, i.e., the perimeter that is in contact with the fluid Note that the hydraulic diameter is equivalent to the geometric diameter for the special case of a circular flow passage:

$$A=\pi R^2=(\pi/4)D^2$$

$$P=\pi D$$

$$Dh=4(\pi/4)D^2/(\pi D)=D$$

An average hydraulic diameter, Dha, may be defined over the transition, by:

where x is distance along flow channel x=x1 at beginning of transition x=x2 at end of transition The above algorithm for Dha can be approximated by:

L/Dha=Ratio of transition length to average hydraulic diameter over entire transition.

Figure 8:
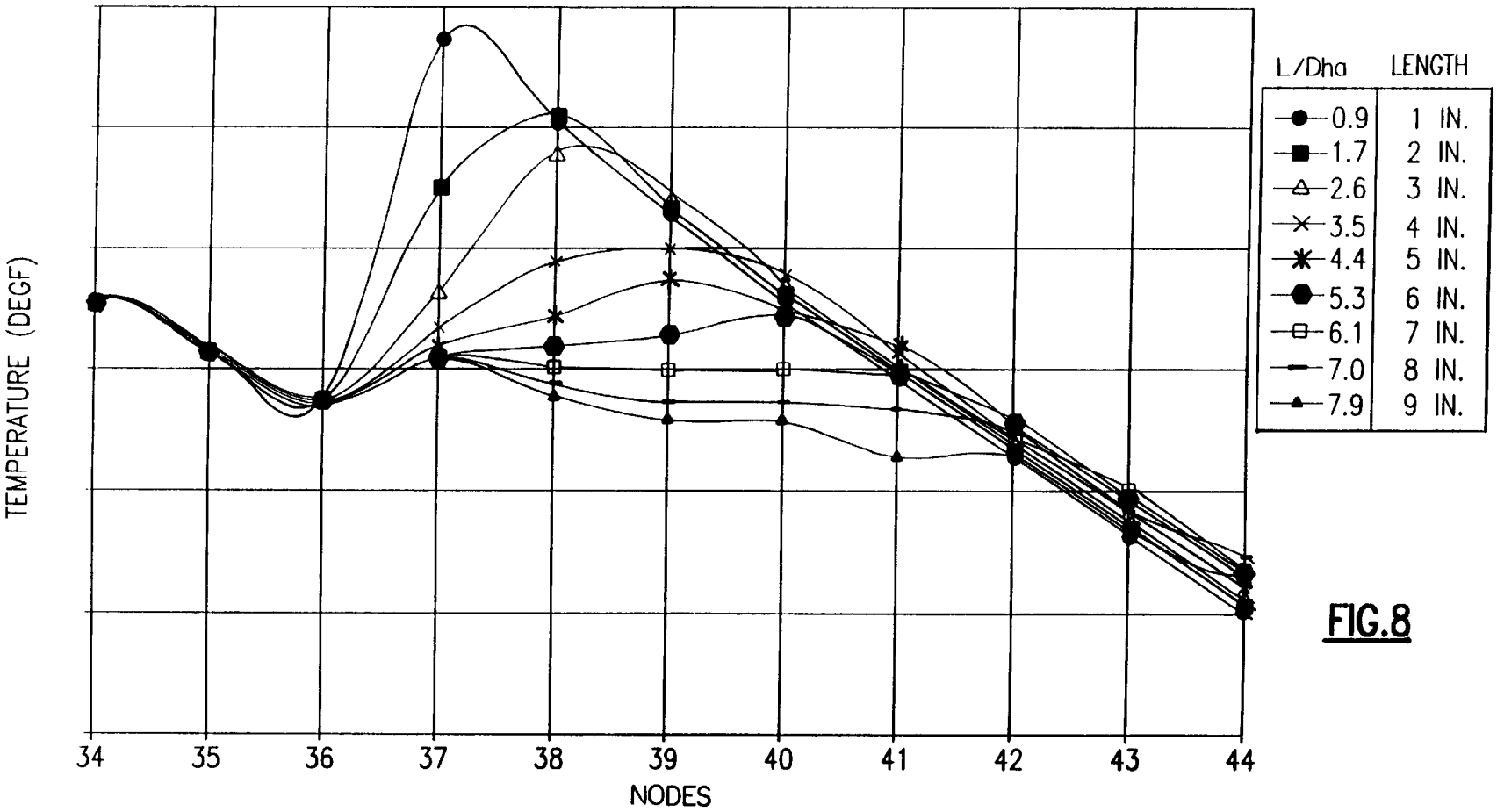
FIG. 8 is a graphic illustration of the heat exchanger wall temperature as a function of the L/Dh ratio of the transition portion.

From an analysis of the data in FIG. 8, it will be seen that, if the transition length is too short, a severe surface hotspot may develop. Depending on the heat exchanger material that is being used, the local stress/strain may exceed durability limits. For example, if a transition length is chosen such that L/Dha=0.9 (L=1 inch), the wall temperature increases sharply, resulting in reduction of durability and life. Further, a relatively steep temperature gradient exists from node 36 to 37. This high-temperature gradient causes excessive strain levels in the material. On the other hand, if a transition length is chosen such that L/Dha=1.7 (L=2 inches), then the maximum wall temperature is substantially reduced, while the gradient between nodes 36 and 37 is reduced as well.

The gradient between nodes 37 and 38 is now relatively low. It is therefore recommended that the L/Dha ratio be no less than 1.7 and the transition length, L, be no less than two inches. Preferably, the L/Dha should be no less than 2.6 and the transition length, L, should be no less than three inches.

A further lengthening of the transition portion further reduces both the maximum wall temperature and the temperature gradients, but it should be recognized that the internal heat transfer coefficient, and therefore the overall efficiency, will also decrease as the transition length increases. Accordingly, it is recommended that the transition length be chosen such that L/Dha≦7.0 (L≦8 inches), and preferably that L/Dha≦6.1 (L≦6.1 inches), since the resultant reduction in temperatures is not warranted by the attendant loss in efficiencies above those lengths.

Figure 9:
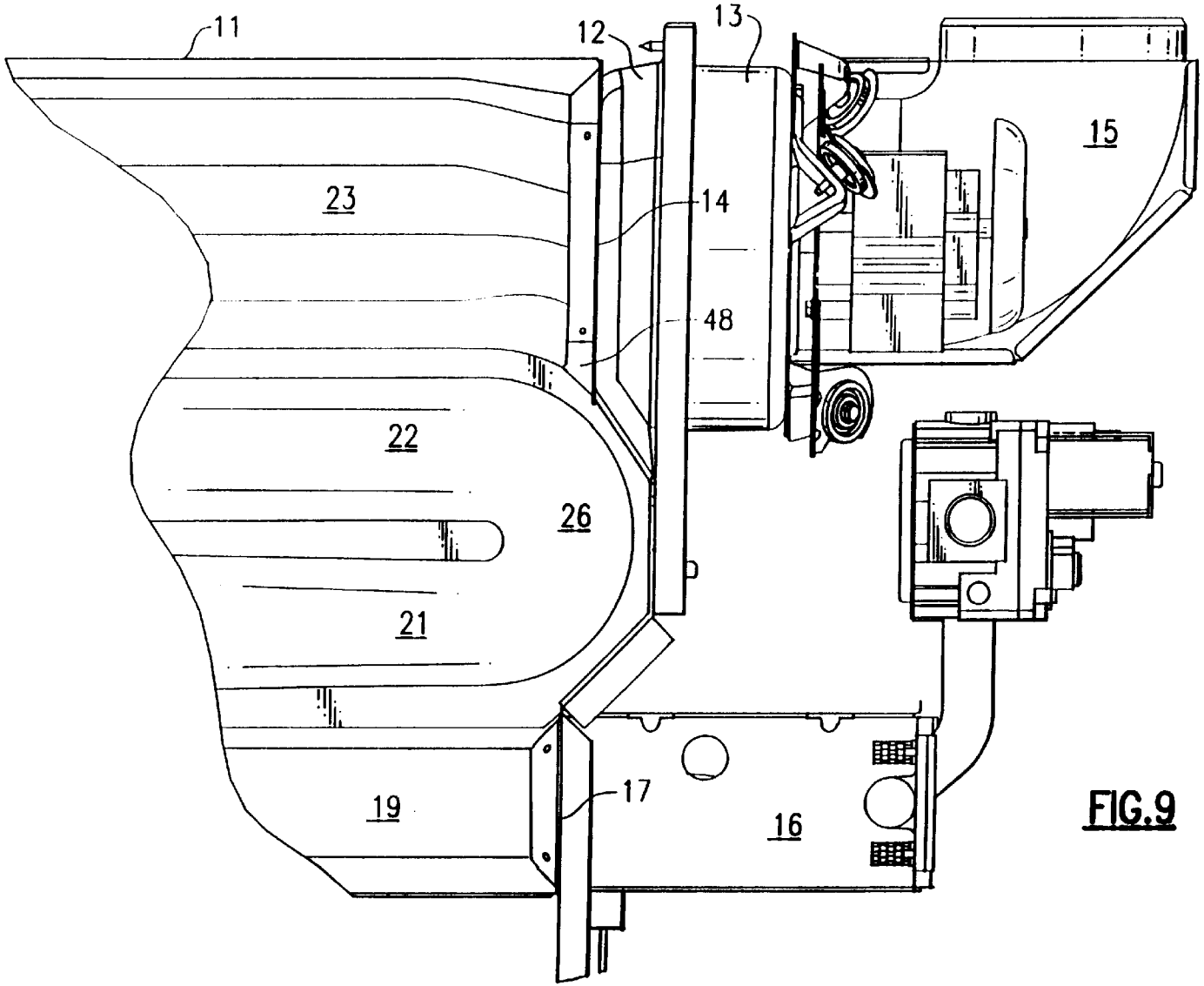
FIG. 9 is a partial view of the heat exchanger panel as interconnected to the burner and inducer assemblies in accordance with the present invention.
Figure 10:
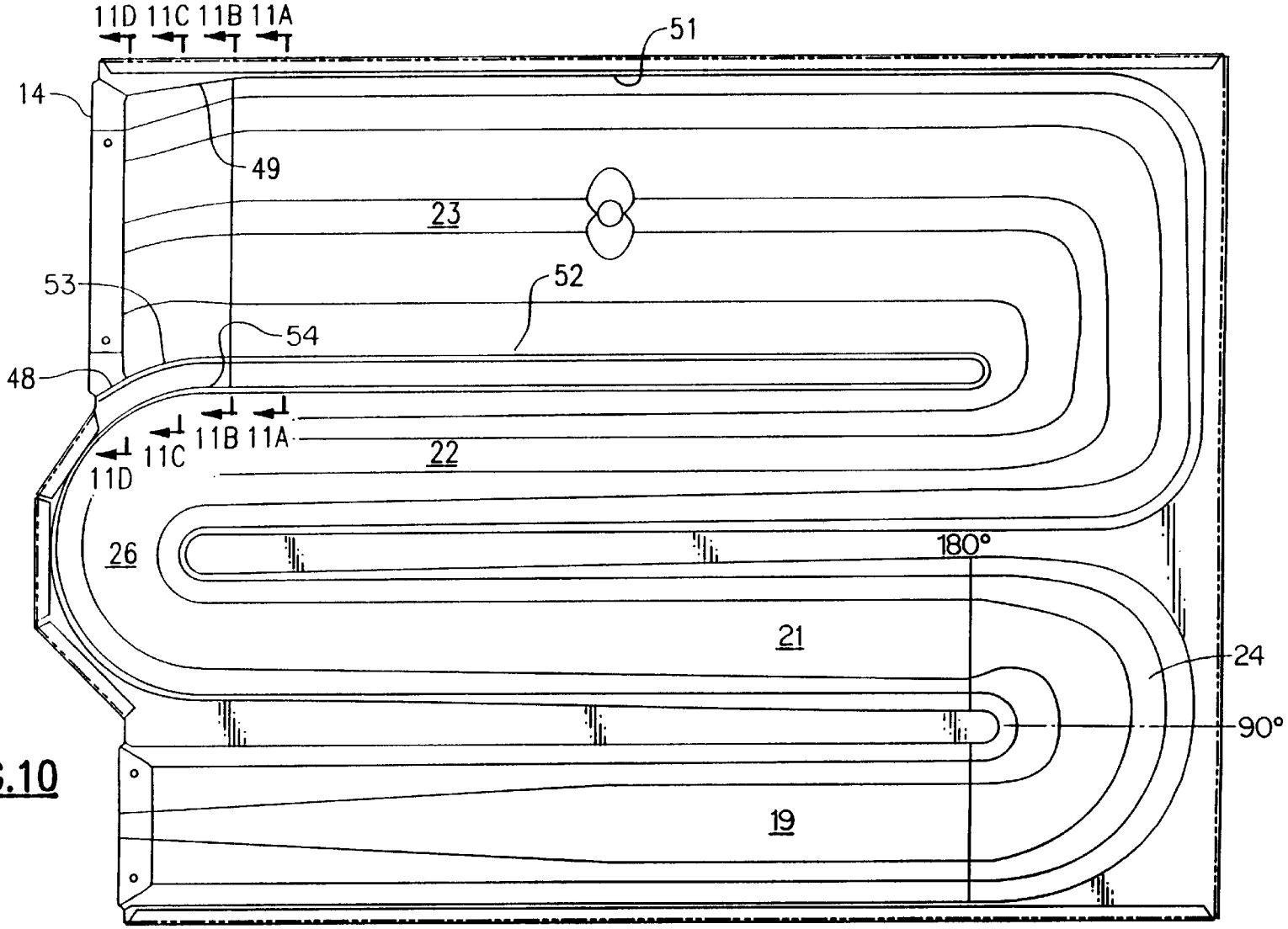
FIG. 10 is a partial view of the heat exchanger panel showing the outlet end thereof in accordance with the present invention.

Referring now to FIGS. 9–11, the heat exchanger panel 11 is shown in partial view to include the last pass 23 as connected at its outlet end 14 to the inducer 13. As will be seen, the outlet end 14 has a bell-like shape 48 to facilitate the attachment to the collector box 12 by expanding outwardly to increase the cross-sectional area as the panel expands from the plane A—A to the outlet end 14. Immediately upstream of the plane A—A, the panel 11 is shaped so as to provide optimum performance characteristics while remaining within the space limitations of the furnace installation. In particular, the overall height of the furnace can be a critical limitation for such installations as in mobile homes and the like. At the same time, it is important that the heat transfer characteristics of the heat exchanger are maximized while minimizing the pressure drop therein. This is accomplished by forming the final portion of the last pass 23 in such a way as to shorten the overall height of the heat exchanger without creating an attendant pressure drop. This form, as shown in FIGS. 9–11, provides a downward extension 49 in the upper wall 51 of the last pass 23, such that, when the belled portion 48 is extended outwardly (upwardly), it does not extend any higher than the plane of the upper wall 51.

Figure 11A:
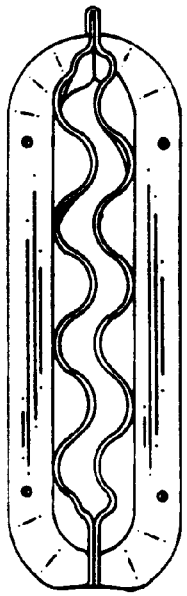
FIGS. 11A–11D are cross-sectional views of the heat exchanger panel as seen along lines A—A, B—B, C—C and D—D of FIG. 10 in accordance with the present invention.
Figure 11B:
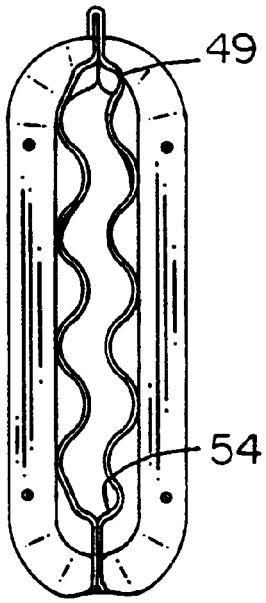
Figure 11C:
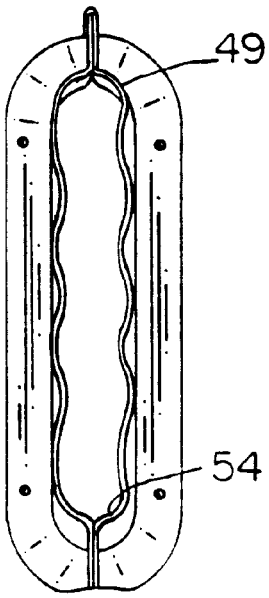
Figure 11D:
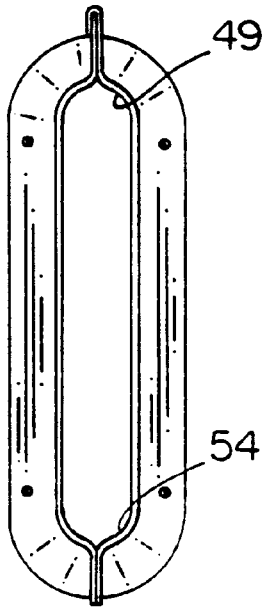

Now, in order not to introduce an attendant pressure drop, it is necessary to offset this apparent shrinking of the flow passage by expanding it elsewhere. This can be accomplished by expanding the sides of the pass 23. But preferably, it is accomplished by curving the lower wall 52 downwardly as shown at 53. In order to use the space provided, the curved portion 53 is preferably of the same, or substantially the same, curvature as that of the curved portion of the adjacent return bend 26. It will therefore be seen that between the plane A—A and the plane D—D of FIG. 10, the cross-sectional shape of the fourth pass 23 transitions from the wavy shape as shown in FIG. 11A to the extended oval shape as shown in FIG. 11D, and the cross-sectional area rather than being decreased by the downward curve 49, is gradually increased over that length. This increase in cross-sectional area significantly reduces the pressure drop that would otherwise occur because of the sudden expansion from the heat exchangers last pass to the collector box in which the flue gas from multiple cells is gathered for delivery to the vent system. In contrast, conventional clam shell heat exchangers have a straight rather than a curved terminal end, such that the cross-sectional area cannot be increased so as to reduce the pressure drop, or it is curved upwardly to allow for an increase in the cross-sectional area but at the expense of increasing the height of the heat exchanger. The present invention thus provides for an increased cross-sectional flow area and a corresponding decrease in pressure drop without an associated increase in height of the heat exchanger.

Figure 12:
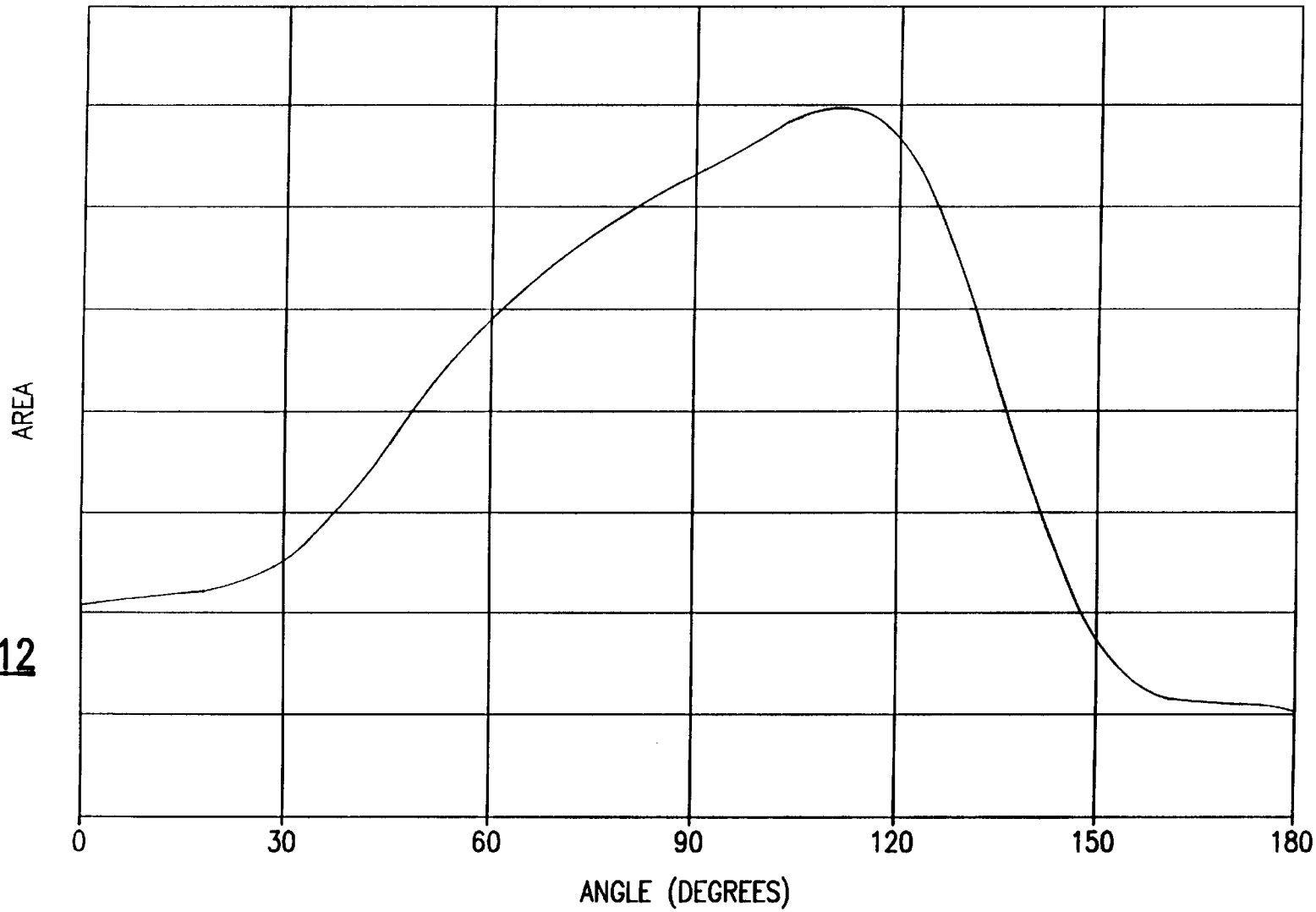
FIG. 12 is a graphic illustration of the variable flow area of the first return bend.

Another critical area for the durability and life of the heat exchangers is the first return bend 24, which connects the first and second flue gas passages 19 and 21 respectively. Typically, hot spots in this region are the most severe. It is thus beneficial to reduce the velocity of the flue gas around the bend, thereby decreasing the flue side heat transfer coefficients and the resulting hot spots. However, a large increase in the cross sectional area would normally result in a passage that has greater height since the second pass then tends to be large resulting in an increase in the overall height of the heat exchanger. As indicated in FIGS. 10 and 12, the present invention first increases the cross sectional area of the return bend to drop the flue gas velocity near the hot spot region and then decreases the cross sectional area in order to reduce the height of the second pass. FIG. 12 shows the cross sectional area of the first return bend 24 as it first increases for about the first 110° of the bend as shown in FIG. 10, and then decreases to the end of the bend at 180°. This change is accomplished by a change in the outer radius of curvature of the outer portion of the bend. However, it may also be accomplished by changing the thickness i.e. in the z dimension of the bend. In the prior art, the cross sectional area of the return bend stays constant, continuously increases or continuously decreases in the direction of the flue flow. It is believed that the present invention provides benefit both with respect to heat exchanger temperatures and overall heat exchanger height.

It should be understood that the invention may be embodied in other specific forms without departing from the true spirit and scope of the invention as described herein. The present examples and embodiments, therefore, are to be considered in all respects as illustrative and not restricted, and the invention is not to be limited to the details given herein. For example, although the heat exchanger passages have been described as having upper and lower walls, it should be understood that these terms are for description purposes only and should not be restricted to their literal meaning since the furnace and the enclosed heat exchanger can be installed in different positions according to installation requirements.

What is claimed is:

1. A furnace heat exchanger for exchanging energy between heated gases flowing internally therein and comfort air flowing externally thereover, comprising:

a series of interconnected flow passages that are superimposed in a first plane for conducting flue gases between an inlet in a first flow passage and an outlet in a last flow passage of said series;

at least two of said flow passages being at least partially formed of a pair of opposed sidewalls with at least one sidewall having a wavy cross sectional shape in a plane substantially normal to both said first plane and to the direction of internal gas flow;

said two flow passages being relatively upstream and downstream with respect to the internal gas flow, with the side walls of the downstream passage having at least as many waves as that of said upstream passage.

2. A furnace heat exchanger as set forth in claim 1 wherein said downstream passage is of a greater height than said upstream passage.

3. A furnace heat exchanger as set forth in claim 1 wherein the sidewalls of said downstream passage have more waves than the sidewalls of said upstream passage.

4. A furnace heat exchanger as set forth in claim 1 wherein at least one of the sidewalls of each of the last two of said interconnected flow passages have wavy cross-sectional shapes.

5. A furnace heat exchanger as set forth in a claim 4 wherein there are four interconnected flow passages and at least one of the sidewalls of the third and fourth flow passages have wavy cross sectional shapes.

6. A furnace heat exchanger as set forth in claim 1 wherein both walls of at least one passage are wavy and said wavy cross sectional shapes are generally sinusoidal in form with the two waves of opposed sidewalls being substantially in phase substantially throughout their length.

7. A furnace as set forth in claim 6 wherein the opposed sidewalls of at least one of said flow passages extend to a common plane.

8. A furnace heat exchanger as set forth in claim 6 wherein the opposed sidewalls of at least one passage pass through a common plane.

9. A furnace heat exchanger as set forth in claim 1 and including an abutment in at least one passage, said abutment comprising an inward indention of at least one sidewall such that the two sidewalls are in an abutting relationship.

10. An improved clam shell heat exchanger for a furnace having a plurality of burners and corresponding heat exchanger cells arranged to transfer heat to circulating air passing over the outer surfaces thereof, wherein the improvement comprises:

a series of flow passages interconnected by return bends for conducting heated gases from a cell inlet to a cell outlet, at least two of said interconnected flow passages having a wavy form cross-sectional shape and with the downstream one of said flow passages having at least as many waves as the upstream one of said flow passages.

11. An improved clam shell heat exchanger as set forth in claim 10 wherein at least one of said at least two flow passages is generally sinusoidal in form.

12. An improved clam shell heat exchanger as set forth in claim 11 wherein both of said at least two flow passages are generally sinusoidal in form.

13. An improved clam shell heat exchanger as set forth in claim 11 wherein said one flow passage has two wavy sidewalls, with the generally sinusoidal sidewalls being generally in phase.

14. An improved clam shell heat exchanger as set forth in claim 13 wherein said two wavy sidewalls pass through a common plane.

15. A multipass clam shell heat exchanger of the type having an inlet end for receiving heated flue gas, an outlet end for discharging cooler flue gas to a vent, and a plurality of passes therebetween, comprising:

at least two of said plurality of passes having sidewalls with cross-sectional shapes that are wavy in form to thereby provide increased surface area for heat exchange purposes; wherein, the sidewalls of the more upstream of said at least two passes have less waves then the more downstream one.

16. A multipass clam shell heat exchanger as set forth in claim 14 wherein said plurality of passes are generally parallel.

17. A furnace heat exchanger cell for exchanging energy between heated gases flowing therein and comfort air flowing thereover, comprising:

an inlet end for receiving heated gases from an associated burner;

an outlet and for discharging exhaust gases to a vent; and a plurality of passes between said inlet and said outlet for conducting the flow of said hot gases, with the gases and the passes being generally cooler as the gases pass from said inlet to said outlet; wherein at least two of said passes have walls with cross-sectional shapes that are wavy in form to thereby increase the heat exchange surface area thereof, and further wherein the more downstream pass has at least as many waves as the upstream one.

18. A furnace exchanger cell as set forth in claim 17 wherein the more downstream pass has more waves than the upstream pass.

19. A furnace heat exchanger for exchanging energy between heated gases flowing internally therein and comfort air flowing externally thereover, comprising:

a series of interconnected flow passages for conducting flue gases between an inlet and an outlet of said series;

at least two of said flow passages being at least partially formed of a pair of opposed sidewalls with at least one sidewall having a wavy cross sectional shape in a plane substantially normal to the direction of internal gas flow;

said two flow passages being relatively upstream and downstream with respect to the internal gas flow, with the downstream passage being of greater height than said upstream passage.

* * * * *